US007108100B2

(12) United States Patent
Stingl

(10) Patent No.: US 7,108,100 B2
(45) Date of Patent: Sep. 19, 2006

(54) WORK STAGE

(75) Inventor: Alexander Stingl, Obersulm-Willsbach (DE)

(73) Assignee: Stingl GmbH Obersulm-Willsbach, (DE)

( * ) Notice: Subject to any disclaimer, the term of this patent is extended or adjusted under 35 U.S.C. 154(b) by 25 days.

(21) Appl. No.: 11/034,306

(22) Filed: Jan. 12, 2005

(65) Prior Publication Data

US 2005/0139421 A1 Jun. 30, 2005

Related U.S. Application Data

(63) Continuation of application No. PCT/EP02/07764, filed on Jul. 12, 2002.

(51) Int. Cl.
*E04G 3/00* (2006.01)
*E04G 3/30* (2006.01)

(52) U.S. Cl. ..... 182/82; 182/150; 248/235

(58) Field of Classification Search ..... 182/150, 182/82, 45, 178.1, 179.1, 113; 248/235; 52/645, 638, 646, 637, 651.1, 126.7, 695
See application file for complete search history.

(56) References Cited

U.S. PATENT DOCUMENTS 401,410 A * 4/1889 Carmichael ..... 182/150
2,888,225 A * 5/1959 McQuin ..... 248/237
3,605,944 A * 9/1971 Rogers et al. ..... 182/82
3,894,634 A * 7/1975 Gotham et al. ..... 248/245
4,029,173 A * 6/1977 Wakabayashi ..... 182/150
4,280,243 A * 7/1981 Durrant ..... 182/82
4,979,725 A * 12/1990 Hutchings et al. ..... 256/64
5,269,394 A * 12/1993 Haroldson, Sr. ..... 182/113
5,379,859 A * 1/1995 Pigman ..... 248/237
5,524,727 A * 6/1996 Yennie, Jr. ..... 182/82
5,638,917 A * 6/1997 Vennen ..... 182/150
5,778,999 A * 7/1998 Nealeigh ..... 182/82
5,896,944 A * 4/1999 McMillian et al. ..... 182/45
6,003,630 A * 12/1999 Whalen ..... 182/82
6,039,150 A * 3/2000 Palmer ..... 182/113
6,264,001 B1 * 7/2001 Herschbach ..... 182/150
6,446,752 B1 * 9/2002 Philippe ..... 182/82

(Continued)

FOREIGN PATENT DOCUMENTS

DE 803 075 2/1951

(Continued)

OTHER PUBLICATIONS

International Search Report, PCT/EP 02/07764, European Patent Office, Feb. 20, 2003.

*Primary Examiner*—Hugh B. Thompson, II
(74) *Attorney, Agent, or Firm*—Darby & Darby

(57) ABSTRACT

A work stage includes a work platform having first and second sides and a cross-beam, a first support part supporting the work platform and a counter-support disposed at the first side. In addition, the work stage includes a first holder including a bolt and attaching the work platform to the first support part and enabling the work platform to rest against the counter-support. A first vertical strut is disposed essentially at a right angle to the cross-beam, a second holder is disposed on the second side and configured to hold the work platform, a tie rod is connected at one end to the second holder and at the other end to the vertical strut, and a second vertical strut is disposed parallel to and at a distance from the first vertical strut and configured to receive at least one transverse strut. The first vertical strut and the crossbeam are bearing mounted at the first holder so as to pivot simultaneously around the bolt.

21 Claims, 4 Drawing Sheets

U.S. PATENT DOCUMENTS 6,494,291 B1 * 12/2002 Ono ..... 182/82

FOREIGN PATENT DOCUMENTS

DE 199 28 574 1/2001
FR 2 641 018 12/1988
JP 1-226687 9/1989
WO WO 00/70169 11/2000

* cited by examiner

Fig. 3
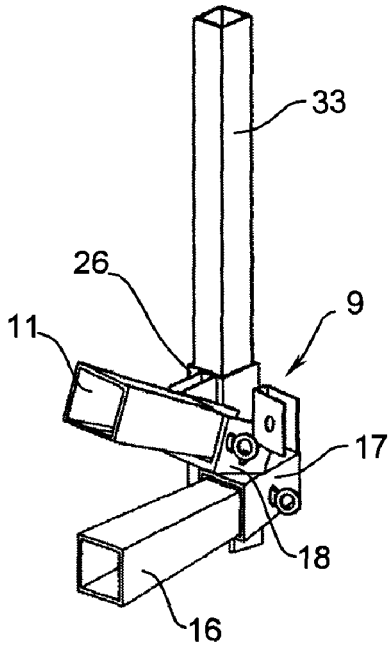
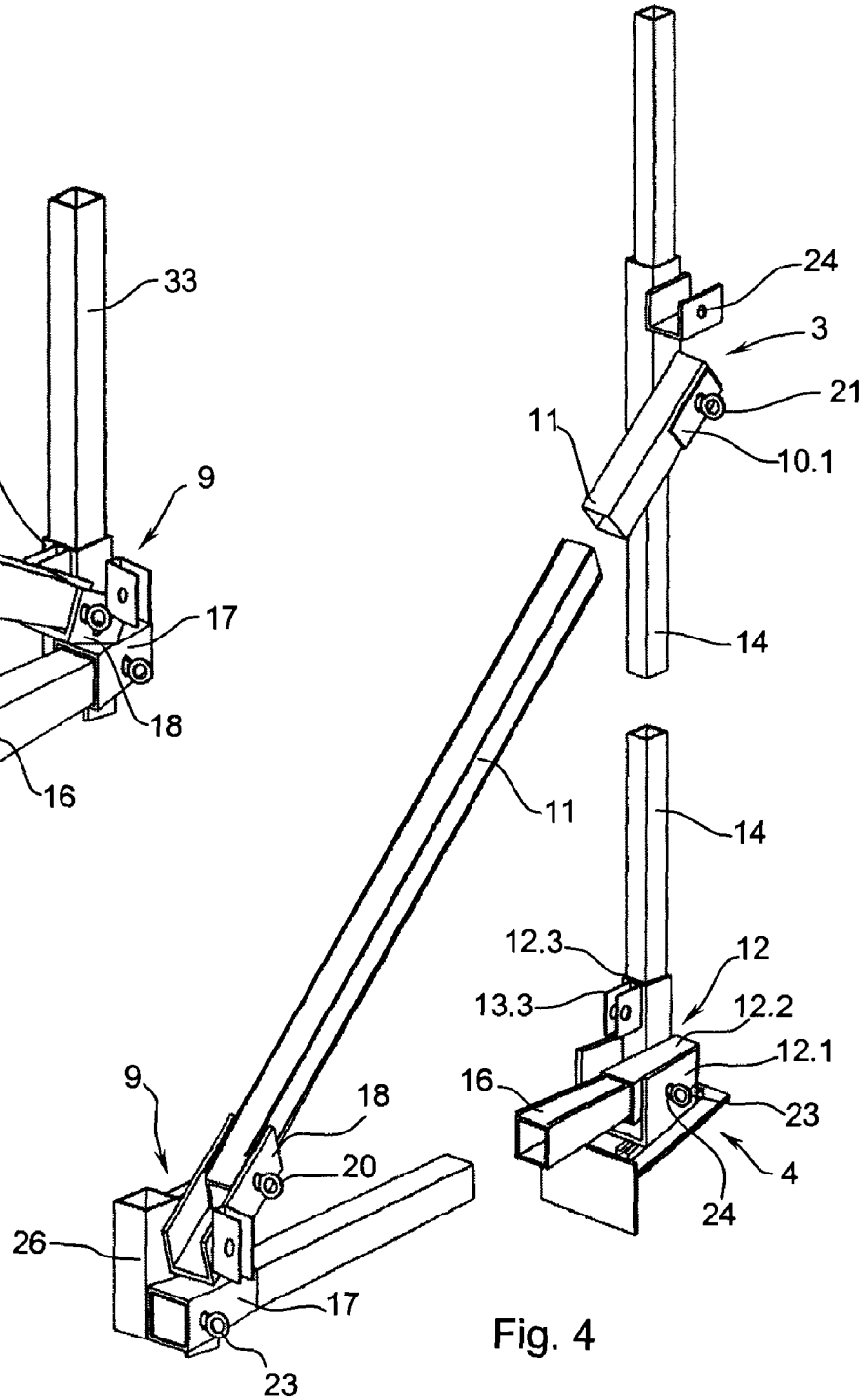
Fig. 4

WORK STAGE

This application is a continuation application of International Patent Application No. PCTEP2002/007764 having an international filing date of Jul. 12, 2002, the entire disclosure of which is incorporated by reference herein.

The present invention relates to a work stage or working gantry, for receiving and/or positioning a work platform.

BACKGROUND

French patent specification FR 2 641 018 relates to an assembly device for elevator shafts. It is attached to the door threshold and has two parallel bars that rest against the opposite wall. In addition, a supporting ladder element is provided as the mode of access to a horizontal work platform. The bars are configured as telescopic rods with locking pins and they enclose an angle of 25° relative to the horizontal. This assembly device is very complex and configured with numerous parts. A rapid and simple assembly is not possible.

Moreover, a work stage is known that has the following features (DE 199 28 574 C2). The work stage comprises a device for receiving and/or positioning a work platform. The device serves to position the work platform and is equipped with a holder or a support part on which the work platform is adjustably arranged and that serves as a bracing part. For this purpose, the holder has an arrangement by means of which the work platform can be supported on one side against a counter-support or against a wall. Moreover, on an opposing side, the work platform has a second arrangement that can likewise be supported against a counter-support or a wall by means of the support part. Facing the opposing side, the holder has a safety mechanism for the work platform that consists of a holding means and of a beam as a supporting device and that has a second support part that can be laid against the wall. The holding means is configured as a tie rod whose one end is connected to the work platform and whose other end is movably connected to the beam. In order for the work platform to be supported, it has to have at least two side walls that are opposite from each other and provided in a shaft section.

German patent specification DE 803 075 C as well as world patent application WO 00/70169 A both describe a work stage with a vertical strut that is rigid with respect to the door opening, whereby a crossbeam for receiving a work platform is bearing-mounted so as to swivel on said vertical strut. The crossbeam is affixed on its side opposite to the vertical strut by means of a tie rod that is attached to the vertical strut above the crossbeam. The tie rod can be articulated so that the work platform can be folded open and closed.

SUMMARY OF THE INVENTION

An object of the present invention is to provide a simply constructed work stage for shafts of elevators or for other shafts that can be installed in the area of the wall opening or door opening by a single person within a short period of time.

The present invention provides a work stage including a device for receiving and/or positioning a work platform, the device for the work platform has a support part to which the work platform is attached by means of a first holder and which supports the entire device. The work platform can rest against a counter-support or a wall in the area of a first side by means of the first holder. The work platform is connected by means of the first holder to a vertical strut that is arranged essentially at a right angle to a crossbeam of the work platform. On a second side opposite from the first side, the work platform has a second holder by means of which the work platform can be held. The second holder is connected to a tie rod that is rigidly and/or movably connected with its one end to the work platform and with its other end to the vertical strut. On the work platform, parallel to and at a distance from the first vertical strut, at least one additional vertical strut can be installed that serves to receive one or more transverse struts.

The vertical strut and the crossbeam of the work platform that are connected to the vertical strut by means of the tie rod are bearing-mounted by means of the first holder so as to pivot simultaneously around a shared bolt on the support part.

Due to the advantageous configuration and arrangement of the work stage, it can also be placed against just one vertical wall that is provided with an opening and it can easily be clamped into this opening without there being a need for a wall element opposite from the wall opening or door opening for this purpose. The work stage is placed in a simple manner with its vertical strut into the wall opening, whereby the lower part rests on a floor or cover section of the floor while the upper part of the vertical strut pivots against the inside of the wall and comes to rest against this wall, from where the assembly is carried out.

With an eye towards simple assembly, it is advantageous for the crossbeam and the vertical strut to be placed into the first holder and subsequently secured by means of a bolt.

For this purpose, it is advantageous for the work platform to be formed by the crossbeam and by a baseplate that lies on the crossbeam, whereby the crossbeam is connected to the tie rod by means of the second holder.

Regarding an adaptation to the shaft size, it is advantageous for the tie rod to be connected to the second holder by means of an articulated joint connection.

It is also advantageous for the first vertical strut to be connected to the second vertical strut by means of three transverse struts that are arranged essentially horizontally.

Regarding a flexible use, it is advantageous that, above the work platform, there is a second work platform with a baseplate that is connected to the first vertical strut and to the second vertical strut by means of a crossbeam.

For this purpose, it is also advantageous for a vertical strut and a vertical rear strut to be associated with the second work platform, whereby the vertical strut is attached to the crossbeam and the rear strut is inserted into the vertical strut.

It is especially advantageous for the vertical strut and the rear strut to be connected by means of three essentially horizontal transverse struts.

For this purpose, it is advantageous for the work platform to have an opening as a passage and for a ladder.

For this purpose, it is advantageous for the first vertical strut to receive or support the entire work platform.

An additional possibility according to an embodiment is that the support part for supporting or receiving the work platform is configured as a mating element and/or as a form-fitting element.

Furthermore, it is advantageous for the support part to be configured as a bracket that can rest against the corner part of a wall or of a door threshold. Through the use of a bracket, the vertical strut can easily rest on and be clamped onto the corner area of the floor, so that the floor bears the main load of the entire work platform, whereby the upper part of the vertical strut merely absorbs the tensile load of the work platform.

It is also advantageous for the first holder to have a vertical receiving part to receive the vertical strut in a form-fitting manner and/or a second horizontal receiving part to receive the horizontal crossbeam to which the baseplate can be connected, and a U-shaped receiving part to receive the vertical and the horizontal receiving parts.

Since horizontal receiving parts are used, side parts or grate fasteners or else additional struts that serve to receive the work platform can be readily mounted on the work platform so that the height can easily be changed within the device in this manner. In the embodiment, only the right-hand part of the work stage is shown. The work stage consists of two similar or identical receiving parts between which the work platform or the baseplate is suspended or attached. Laterally, the baseplate or the work stage is secured by lateral delimitations which are configured as transverse struts.

According to a preferred embodiment of the solution according to the invention, it is finally provided that at least the horizontal receiving part and the vertical receiving part form a one-piece component.

An especially significant aspect for the present invention is the fact that the U-shaped receiving part can be permanently connected to the support part configured as a bracket.

In conjunction with the configuration and arrangement according to the invention, it is advantageous for the tie rod to be connected to the vertical strut by means of an upper holder in the area of the upper part of said vertical strut.

It is also advantageous for the holders and/or the vertical struts to each have at least one connecting means that serves to receive horizontal or approximately horizontal or slanted additional transverse struts and/or baseplates.

Moreover, it is advantageous that the connecting means are adjustably mounted on the vertical struts and can be attached to the vertical struts by means of safety elements or bolts.

Moreover, it is advantageous for some of the receiving parts to be configured as a tube and some as a bracket, L-shaped part or U-shaped part.

It is also advantageous that the receiving parts, which are connected to each other, can be connected to each other in an articulated manner.

It is also advantageous for the work platform or the baseplate to be of such a width and/or length that it can be pivoted through the door opening.

BRIEF DESCRIPTION OF THE DRAWINGS

Additional advantages and details of the invention are explained in the claims and in the description and depicted in the figures, which show:

FIGS. 3 and 4 various arrangements for connecting the struts of the work stage.

DETAILED DESCRIPTION

Figure 1A:
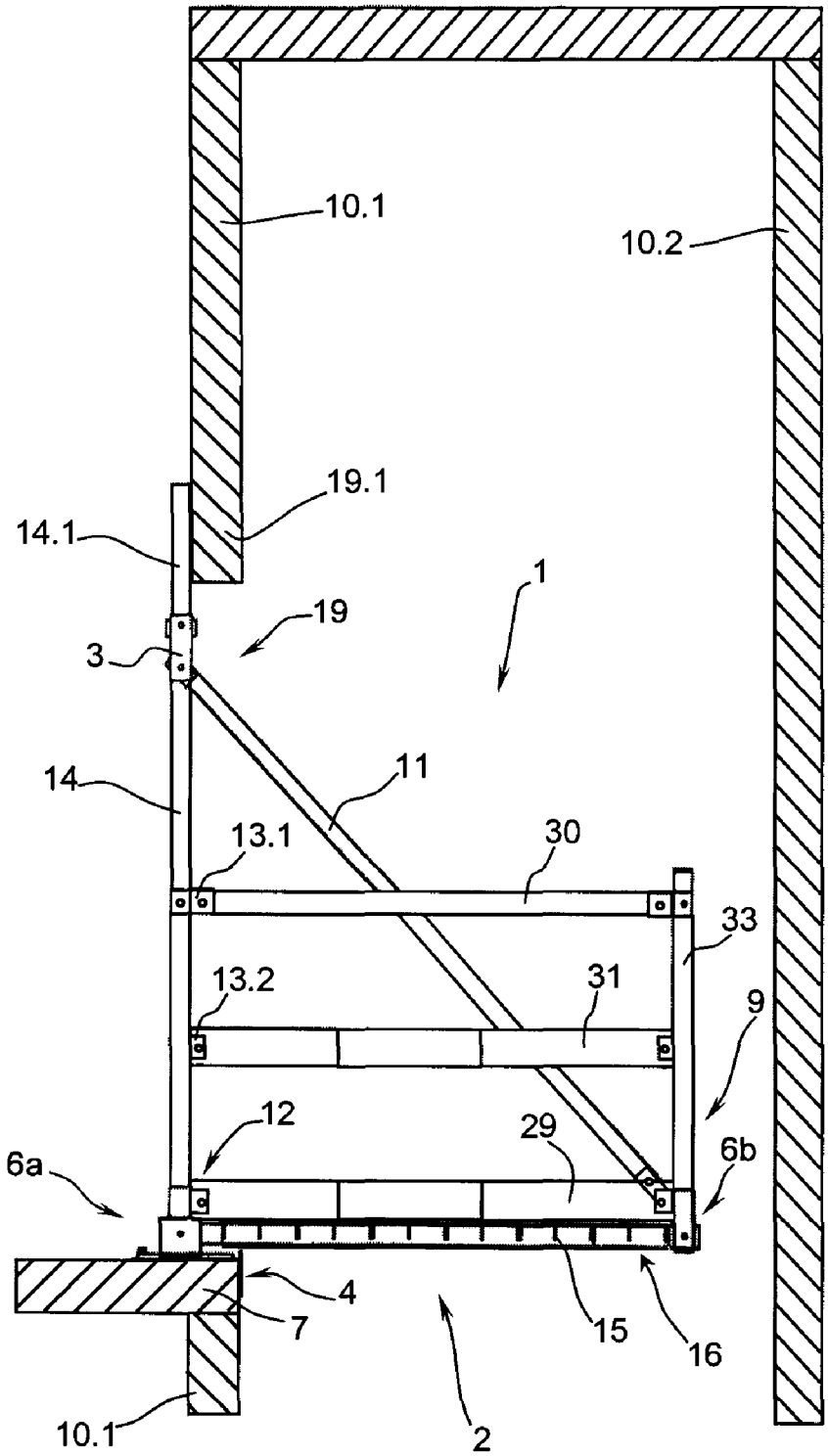
FIG. 1*a* a schematic depiction of a work stage that can be used in elevator shafts or placed in wall openings of buildings.

In the drawing, the reference numeral 1 designates a device for receiving and/or for positioning a work platform which can be placed and attached either between two opposing walls 10.1, 10.2 of an elevator shaft or, in a simple manner, in the opening of a vertical wall 10.1, in the area of a door threshold 7. The device 1 for securing the work platform has a foot that is configured as a support part 4 and, in this embodiment, consists of a bracket. In an advantageous manner, the support part 4 or the bracket can be placed onto a corner edge at the bottom of a wall 10.1 or of a door threshold 7 serving as a counter-support and, in this way, it can hold the entire device 1 for receiving and/or positioning the work platform 2. A first holder 12 is securely attached to the support part or to the bracket 4.

The first holder 12, as shown in FIG. 4, consists of a horizontal receiving part 12.1 whose cross section is U-shaped. A horizontal receiving part 12.2 is placed into the U-shaped receiving part 12.1 of the holder 12, and said receiving part is configured as a square or rectangular tube and can be connected to a vertical receiving part 12.3 or welded to the wall sections of the vertical receiving part 12.3 that is configured as a square or rectangular tube. A horizontal crossbeam 16 is inserted and likewise secured in the horizontal receiving part 12.2 of the first holder 12. One or more bores 24 can be provided in the legs of the U-shaped receiving part 12.1 in order to receive a bolt 23 that extends through bores (not shown in the drawing) of the horizontal receiving part 12.2, of the crossbeam 16 and of the vertical receiving part 12.3. There can also be several bores arranged next to each other in the legs of the U-shaped receiving part 12.1 and/or in the crossbeam 16, so that the crossbeam 16 can be moved horizontally in the receiving part 4 and adapted to the different conditions, for example, with respect to FIGS. 1*a* and 1*b*, to the shaft width between the walls 10.1, 10.2.

Laterally from the crossbeam 16, the lower end of a vertically oriented strut or vertical strut 14 can be received in the vertical receiving part 12.3. The vertical strut 14 can likewise be locked by the above-mentioned bolt 23. The vertical strut 14 can be configured as a simple rectangular tube or as a telescopic tube, so that the length of the vertical strut 14 can be changed and adapted to the varying working conditions.

Figure 1B:
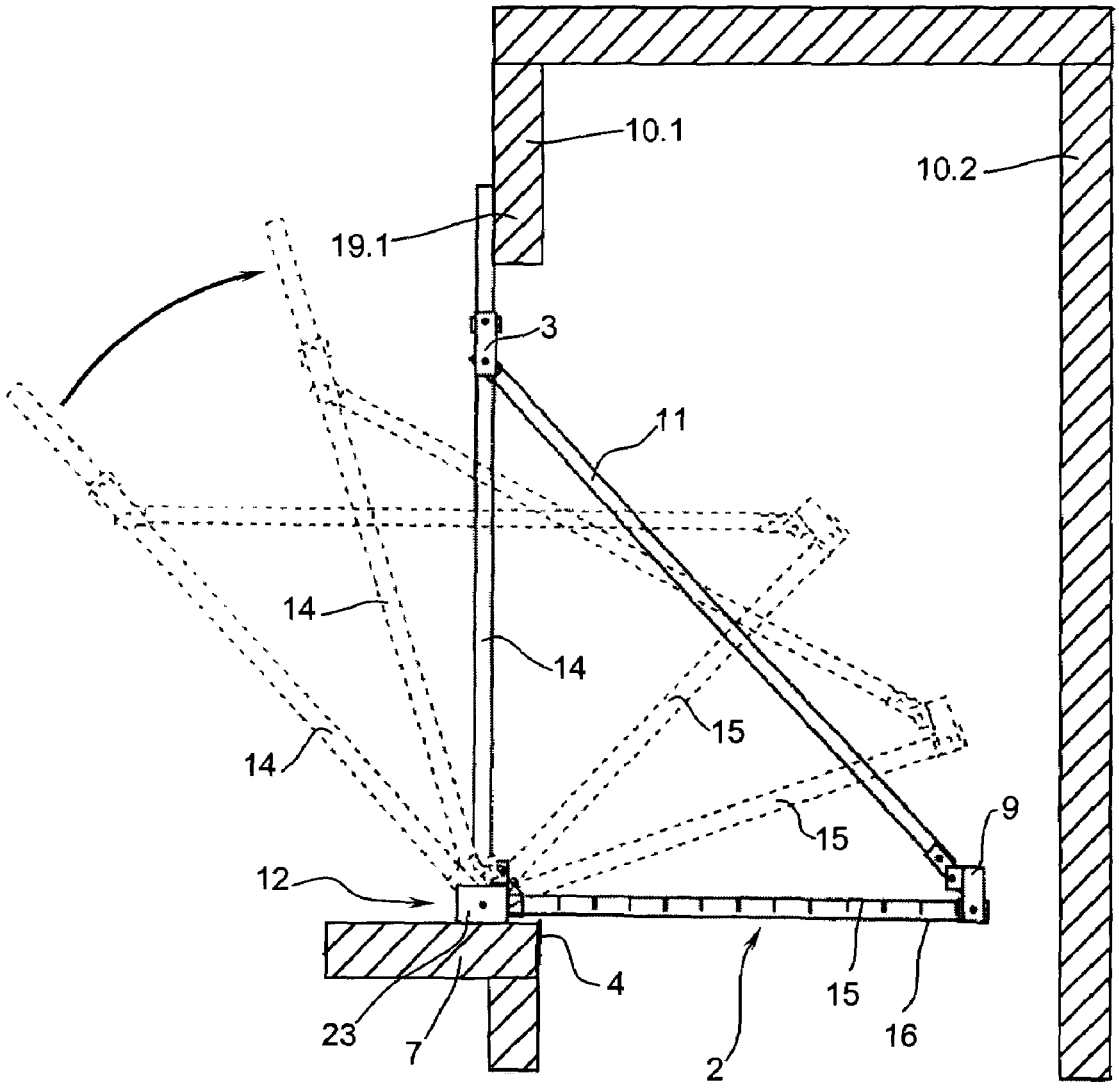
FIG. 1*b* various positions of the pivotable work stage.

The first holder 12, as already mentioned, is connected to the bracket 4 either permanently or else detachably by means of screw elements (not shown here). The embodiment depicted in FIG. 4 shows only the right-hand receiving part 12. However, the work platform 2 requires at least two identical first holders 12 that are at a distance from each other in a direction that is at a right angle to the drawing plane, on each of which a crossbeam 16 is provided. A baseplate 15 is depicted in FIGS. 1*a* and 1*b* which rests on the two crossbeams 16 that are arranged at a distance from each other and which can be attached to said crossbeams 16. The first holder 12, which is offset towards the back at a right angle to the drawing plane, and the appertaining crossbeam 16 are not shown. The baseplate 15 forms the work platform 2 on which the worker can move freely.

The support part 4 is attached at a first side 6*a* of the work platform 2. At a second side 6*b* of the work platform 2 opposite from the support part 4, there is a second holder 9 which is depicted in greater detail in FIGS. 3 and 4. The second holder 9 serves to connect a tie rod 11, which here is connected at one end to the second holder 9 rigidly or movably by means of a bolt or an articulated joint connection 20 respectively, while the other end of the tie rod 11 is connected to another vertical, upper holder 3, likewise by means of a hinge bolt 21. The upper holder 3 according to FIGS. 2 and 4 is connected to the vertical strut 14 rigidly, but in such a way that its height is adjustable.

The second holder 9, as shown in FIGS. 3 and 4, consists of a vertical receiving part 26 and of a horizontal receiving part 17 that can likewise be configured as rectangular tubes. A vertical strut 33 is held in the receiving part 26 and the horizontal crossbeam 16 is held in the receiving part 17. The crossbeam 16 and the vertical struts 33 are illustrated in greater detail in FIGS. 1*a* and 2 and can be secured by means of the bolts 23 shown in FIG. 4.

The receiving part 26 is followed by a slanted receiving part 18 whose cross section consists of a U-shaped section into which the lower end of the tie rod or of the slanted strut 11 is inserted and secured by means of the safety bolt 20. There can be several bores arranged next to each other in the receiving part 19 and/or in the tie rod 11 so that the safety bolt 20 can be inserted in various positions, thus changing the connection site of the tie rod 11. The other or upper end of the tie rod 11 is likewise arranged in a slanted receiving part 18.1 and locked by means of the safety bolt 21. The two receiving parts 18 and 18.1, which enclose an angle of 45° relative to the vertical or horizontal, can also be connected to the horizontal receiving part 17 and to the vertical receiving part 26 in such a way that the angular position of the receiving part 18.1 or 18 can change with respect to the horizontal.

Figure 2:
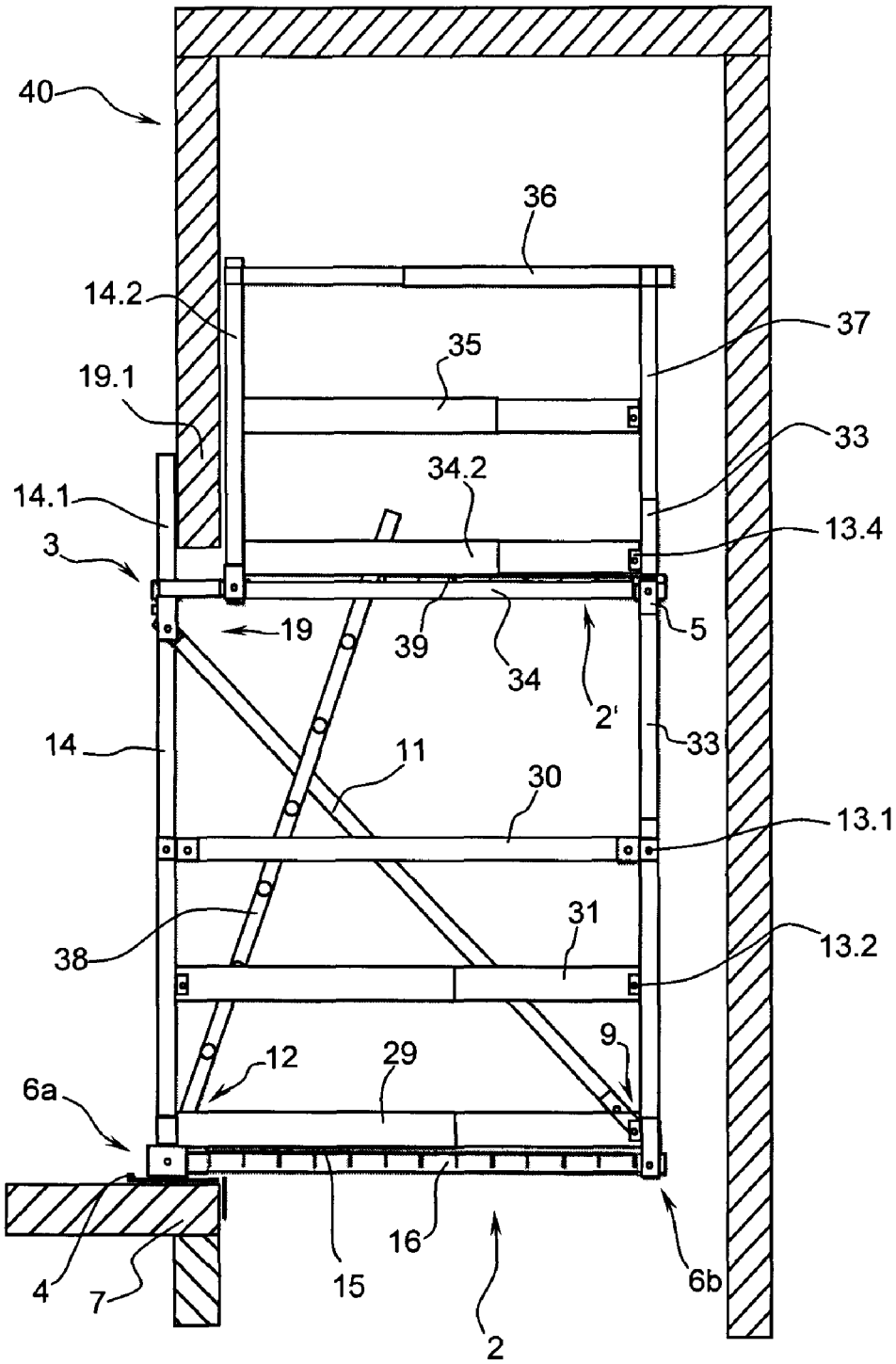
FIG. 2 another embodiment of the work stage with a double frame, which is attached to the upper end of the work stage.

The two holders 9 and 12 are located on both sides of the work stage 2, which is rectangular in shape in the embodiment according to FIGS. 1*a*, 1*b* and 2. In the embodiment, there are two vertical struts 14, 33 to which the tie rod 11 is attached. The vertical struts 14, 33 are arranged at a distance from each other, whereby the vertical strut 33 is provided in the area of the second side 6*b* on the baseplate 15. The horizontal crossbeam 16 for receiving the baseplate 15 and the transverse struts 29, 30 and 31 or, according to FIG. 2, the transverse struts 34.2, 35 and 36 and the crossbeam 34 for receiving another baseplate 39, are located between the vertical struts 14 and 33. According to FIG. 1*a*, the ends of the transverse struts 29 to 31 or 34.2 to 36 are each held in connecting means 13.1, 13.2. The connecting means 13.1, 13.2, as shown by way of the example of the connecting means 13.3 according to FIG. 4, are attached to the various holders 12 and 9 or, according to FIG. 2, directly to the vertical struts 14 and 33.

The connecting means can likewise each be placed with one holder onto the vertical struts 14, 33. The connecting means 13.1, 13.2, as already mentioned and shown in FIG. 1*a*, serve to receive the horizontal transverse struts 30, 31. According to FIG. 2, the transverse strut 34.2 is connected to the connecting means 13.4, which is directly attached to the holder 5. The transverse struts 29 to 31 and 34.2 to 36, including the connecting means 13.1 to 13.4 and the crossbeams 16, 34, can be locked with the bolts (not shown in the drawing), whereby the transverse strut 36 can be configured as a handrail.

The transverse struts 29 to 31 and 34.2 to 36 serve to laterally delimit the work platforms 2, 2' and also to safeguard the worker on the work platforms 2, 2'. Moreover, however, the crossbeams 16, 34 can also to serve to receive baseplates 15 that, depending on the working conditions, can be mounted at different heights so as to accordingly follow the work progress upwards and to provide the operator with one or more work platforms 2, 2' at various levels.

In the embodiment, according to FIG. 2, another vertical strut 14.2 and a rear strut 37 are provided, whereby the lower end of the vertical strut 14.2 can be connected to the transverse strut 34 permanently and/or detachably by means of a connecting means. The vertical strut 14.2 likewise has connecting means on which the transverse struts 35, 34.2 and 36 are placed. This results in two different work platforms 2, 2' at different heights. The upper work platform 2' or the baseplate 39 can be accessed via a ladder 38 that stands upright in the area of the lower work platform 2.

In an advantageous manner, the vertical strut 14 and/or a vertical strut 14.2 are configured in such a way that they can bear the entire weight of one or more work platforms with all of the appertaining individual parts. For this purpose, the vertical strut 14, as already mentioned, rests with its lower end against the wall section 10.1 and with its upper contact part 14.1 against the inside 40 of a door lintel 19.1 of a door opening 19. The door lintel 19.1 absorbs the entire tilting moment of a work platform 2. The other parts of the work platform 2 are secured only by the two tie rods 11 situated next to each other. Additional support elements are not necessary.

The crossbeams 16 and the transverse struts 29 to 31 and 34 to 36 can likewise be configured with a variable length. Therefore, for example, the working area of the work platform 2 can be enlarged or the work platform 2 can be adapted to the depth of the shaft (not shown in the drawing).

What is claimed is:

1. A work stage comprising:

a work platform having first and second sides and a cross-beam;

a first support part supporting the work platform;

a first holder including a bolt and attaching the work platform to the first support part and enabling the work platform to rest against a counter-support disposable at the first side;

a first vertical strut disposed essentially at a right angle to the cross-beam;

a second holder disposed on the second side and configured to hold the work platform;

a tie rod connected at one end to the second holder and at the other end to the first vertical strut;

a second vertical strut disposed parallel to and at a distance from the first vertical strut and configured to receive at least one transverse strut, wherein the first vertical strut and the crossbeam are bearing mounted at the first holder so as to pivot simultaneously around the bolt.

2. The work stage as recited in claim 1, wherein the crossbeam and the vertical strut are received in the first holder and subsequently secured by the bolt.

3. The work stage as recited in claim 2, wherein the work platform includes a baseplate disposed on the crossbeam, and wherein the crossbeam is connected to the tie rod using the second holder.

4. The work stage as recited in claim 3, further comprising an articulated joint connection connecting the tie rod to the second holder.

5. The work stage as recited in claim 4, further comprising three transverse struts disposed essentially horizontally and connecting the first vertical strut to the second vertical strut.

6. The work stage as recited in claim 5, second comprising a second work platform disposed above the work platform, the second work platform including a baseplate connected to the first vertical strut and to the second vertical strut by means of a second crossbeam.

7. The work stage as recited in claim 6, further comprising a third vertical strut and a fourth vertical rear strut associated with the second work platform, the third vertical strut is attached to the second crossbeam and the fourth vertical strut is inserted into the second vertical strut.

8. The work stage as recited in claim 7, further comprising three essentially horizontal transverse further struts connecting the third vertical strut and the fourth vertical strut.

9. The work stage as recited in claim 8, wherein the second work platform includes an opening configured to receive a ladder.

10. The work stage as recited in claim 1, wherein the first vertical strut receives or supports the entire work platform.

11. The work stage as recited in claim 1, wherein the first support part includes a bracket that is configured to rest against a corner part of a wall.

12. The work stage as recited in claim 11, wherein the corner part of the wall includes a door threshold.

13. The work stage as recited in claim 1, wherein the first holder has at least one of a vertical receiving part and a horizontal receiving part, the vertical receiving part configured to receive the first vertical strut in a form-fitting manner and the horizontal receiving part configured to receive the crossbeam.

14. The work stage as recited in claim 13, wherein the first holder has a U-shaped receiving part to receive the vertical and the horizontal receiving parts.

15. The work stage as recited in claim 14, wherein the U-shaped receiving part is configured as a bracket and permanently connected to the first support part.

16. The work stage as recited in claim 13, wherein the horizontal receiving part and the vertical receiving part form a one-piece component.

17. The work stage as recited in claim 1, further comprising an upper holder disposed at an upper part of the first vertical strut and connecting the tie rod to the first vertical strut.

18. The work stage as recited in claim 1, wherein at least one of the first holder, the second holder, the first vertical strut and the second vertical strut includes at least one connecting connector configured to receive an additional strut.

19. The work stage as recited in claim 18, wherein the additional strut is one of a horizontal transverse strut, a slanted transverse strut, and a baseplate.

20. The work stage as recited in claim 18, wherein the at least one connector is adjustably mounted on one of the first and second vertical struts and attachable to the vertical strut using one of a safety elements and a bolt.

21. The work stage as recited in claim 18, wherein the work platform is dimensioned so as to be pivotable through a door opening.

* * * * *

UNITED STATES PATENT AND TRADEMARK OFFICE

CERTIFICATE OF CORRECTION

PATENT NO. : 7,108,100 B2
APPLICATION NO. : 11/034306
DATED : September 19, 2006
INVENTOR(S) : Alexander Stingl It is certified that error appears in the above-identified patent and that said Letters Patent is hereby corrected as shown below:

On Title Page item 73
In the Assignee:

Please delete "Stingl GmbH Obersulm-Willsbach, (DE)" and substitute with
-- Stingl GmbH, Obersulm-Willsbach, (DE)--.

Signed and Sealed this

Nineteenth Day of December, 2006

JON W. DUDAS
*Director of the United States Patent and Trademark Office*